US009219317B1

(12) United States Patent
Strassner, II

(10) Patent No.: US 9,219,317 B1
(45) Date of Patent: Dec. 22, 2015

(54) DELIVERING BOTH SUM AND DIFFERENCE BEAM DISTRIBUTIONS TO A PLANAR MONOPULSE ANTENNA ARRAY

(75) Inventor: Bernd H. Strassner, II, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 634 days.

(21) Appl. No.: 13/556,348

(22) Filed: Jul. 24, 2012

(51) Int. Cl.
*H01Q 25/02* (2006.01)
*H01Q 21/00* (2006.01)

(52) U.S. Cl.
CPC ..... *H01Q 25/02* (2013.01); *H01Q 21/0006* (2013.01); *H01Q 21/0075* (2013.01)

(58) Field of Classification Search
IPC ..... H01Q 25/02,21/00006, 21/0075
See application file for complete search history.

(56) References Cited

U.S. PATENT DOCUMENTS

| | | | | |
|---|---|---|---|---|
| 4,595,926 | A * | 6/1986 | Kobus et al. | 342/368 |
| 4,618,831 | A * | 10/1986 | Egami et al. | 330/124 R |
| 5,612,702 | A * | 3/1997 | Kinsey | 342/427 |
| 2005/0035825 | A1 * | 2/2005 | Carson | 333/117 |
| 2011/0248796 | A1 * | 10/2011 | Pozgay | 333/137 |

OTHER PUBLICATIONS

R.J. Mailloux, Antenna array architecture, Proceedings of the IEEE, vol. 80(1), p. 163-172, 1992.*
Microwaves101.com Encyclopedia, Hybrid (3 dB) couplers, http://www.microwaves101.com/encyclopedias/hybrid-couplers, 2001.*
M. Alvarez-Folgueiras et al., Synthesising Taylor and Bayliss Linear Distributions with Common Aperture Tail, Electronics Letters Jan. 1, 2009, vol. 45, No. 1 (2 pages).

* cited by examiner

*Primary Examiner* — Gregory C Issing
*Assistant Examiner* — Fred H Mull
(74) *Attorney, Agent, or Firm* — Madelynne J. Farber

(57) ABSTRACT

A planar monopulse radar apparatus includes a planar distribution matrix coupled to a planar antenna array having a linear configuration of antenna elements. The planar distribution matrix is responsive to first and second pluralities of weights applied thereto for providing both sum and difference beam distributions across the antenna array.

20 Claims, 5 Drawing Sheets

DELIVERING BOTH SUM AND DIFFERENCE BEAM DISTRIBUTIONS TO A PLANAR MONOPULSE ANTENNA ARRAY

This invention was developed under Contract DE-AC04-94AL85000 between Sandia Corporation and the U.S. Department of Energy. The U.S. Government has certain rights in this invention.

FIELD

The present work relates generally to monopulse radar systems and, more particularly, to feed networks driving monopulse radar antenna arrangements.

BACKGROUND

The following materials are fully incorporated herein by reference: R. C. Hansen, *Phased Array Antennas*, Wiley-Interscience, New York, 1998; and R. J. Mailloux, *Phased Array Antenna Handbook*, Artech House, Boston, 2005.

The design of array antennas for monopulse radar tracking or search systems quite often requires optimization of the sum pattern-to-sidelobe level (SLL) ratio, while still maintaining high directivity of the sum beam. A difference beam may be provided as an auxiliary pattern with a boresight null coincident with the beam peak of the sum pattern. The tracking drive system adjusts the antenna position until the signal in the difference beam reaches a minimum, thereby causing the sum beam to point accurately at the radar target.

Most conventional monopulse radar systems implement a dish reflector/comparator combination to accomplish their antenna functions. Monopulse radar functionality is implemented with parabolic reflector antennas having waveguide comparators at their feed locations.

Some conventional monopulse systems use planar patch antenna arrays rather than relying solely on dish antennas. Low SLLs, on the order of 30 dB, have been realized with planar patch array technology over a 20% fractional bandwidth. These planar patch arrays are typically single port antennas with only a boresighted sum beam based on Taylor weights.

A Bayliss aperture distribution may be used to achieve low SLLs in the difference beam. Some efforts have been made to simplify methods for acquiring Bayliss and Taylor weights on the same antenna aperture. One approach proposes shaping the "aperture tails" of the Bayliss and Taylor distributions to be the same, in order to reduce the complexity of the feed network. However, in the context of a linear antenna array, this approach addresses less than half of the array's feeding. Other more complex systems, such as used by military ships and aircraft, employ active amplification in conjunction with phase shifters to obtain the desired magnitudes and phases. These military systems are typically implemented with coaxial cable or waveguide elements.

It is desirable in view of the foregoing to provide for an antenna array distribution network that provides distributions for sum or difference patterns across a radiating aperture in a monopulse radar system.

DETAILED DESCRIPTION

Example embodiments of the present work provide a planar monopulse radar apparatus including a distribution matrix coupled to an antenna array. The distribution matrix receives weights (e.g., Taylor weights) associated with a sum pattern and weights (e.g., Bayliss weights) associated with a difference pattern, and delivers both sum and difference beam distributions across the antenna array. The distribution matrix includes a plurality of 0°/180° comparator components, and a plurality of crossover components. These components collectively form a passive, planar network that distributes the sum and difference pattern weights in-plane to the antenna array. The capability of delivering either the sum or difference distribution to the antenna array advantageously allows the antenna array to achieve low SLLs in both its sum and difference beam patterns.

Figure 1:
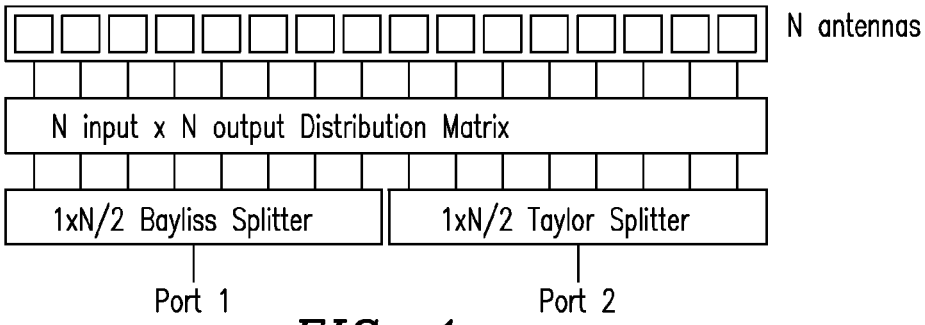
FIG. 1 diagrammatically illustrates a monopulse radar system according to example embodiments of the present work.

FIG. 1 diagrammatically illustrates a monopulse radar system according to example embodiments of the present work. As shown, a feed network is coupled between two input ports (port 1 and port 2) and an arrangement of N antennas. The feed network includes a 1×N/2 Taylor splitter, a 1×N/2 Bayliss splitter, and a distribution matrix (also referred to herein as a distribution network) having N inputs and N outputs. The distribution matrix provides channels that transfer Taylor and Bayliss weights from the respectively associated splitters to the N antenna elements.

The Taylor and Bayliss splitters, and the antenna arrangement are provided with planar constructions, as is known in the art. The distribution matrix is also provided as a planar structure, as described in detail below. In some embodiments, the splitters and the distribution matrix are provided as stripline constructions.

Figure 2:
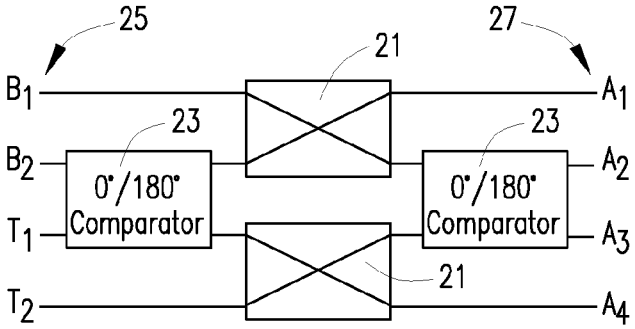
FIG. 2 diagrammatically illustrates the distribution network of FIG. 1 in more detail according to example embodiments of the present work.

FIG. 2 diagrammatically illustrates the distribution matrix (also referred to herein as distribution network) of FIG. 1 in more detail according to example embodiments of the present work. In the example of FIG. 2, two crossover components 21 and two 0°/180° comparator components 23 collectively deliver two Bayliss weights ($B_1$ and $B_2$) and two Taylor weights ($T_1$ and $T_2$) from four input ports at 25 to a linear antenna array of four antenna elements $A_1$-$A_4$ associated with four output ports at 27. In some embodiments, all ports of FIG. 2 are matched to 50Ω. The arrangement of FIG. 2 operates as follows. With the $T_1$ and $T_2$ ports terminated to 50Ω: the $B_1$ weight propagates to $A_2$ and $A_3$, where $A_2$ and $A_3$ have the same magnitude but are 180° out of phase; and the $B_2$ weight propagates to $A_1$ and $A_4$, where $A_1$ and $A_4$ have the same magnitude but are 180° out of phase. With the $B_1$ and $B_2$ ports terminated to 50Ω: the $T_1$ weight propagates to $A_1$ and $A_4$, where $A_1$ and $A_4$ have the same magnitude and are in-phase; and the $T_2$ weight propagates to $A_2$ and $A_3$, where $A_2$ and $A_3$ have the same magnitude and are in-phase.

In general, if the number of antenna elements is denoted by $N_a$, the number of 0°/180° comparator components 23 (also referred to as simply, comparators) necessary to complete an appropriately corresponding feed network is $$N_c = \frac{N_a}{2}$$

Similarly, the number of crossover components 21 (also referred to as simply, crossovers) needed is $$N_x = 2\sum_{m=1}^{\frac{N_a}{2}}\left(\frac{N_a}{2} - m\right).$$

Figure 3:
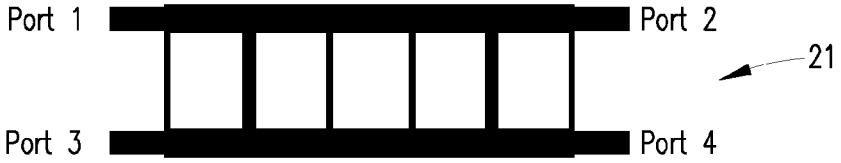
FIG. 3 (PRIOR ART)
FIG. 3 diagrammatically illustrates a conventional example of the crossover components of FIG. 2.

An example of the crossover 21 is diagrammatically illustrated in FIG. 3. The crossover of FIG. 3 is a planar stripline component, constructed with two double-box 90° branchline couplers cascaded as shown. The double-box configuration is known in the art and commonly used in order to obtain wider bandwidths. (Some embodiments have a bandwidth of 9.2 GHz to 10.5 GHz.) Power input at ports 1, 2, 3, and 4 (ideally) exits at ports 4, 3, 2 and 1, respectively. Thus, power input at port 1 crosses with power input from port 2 in-plane, without requiring any vertical transition.

Figure 4:
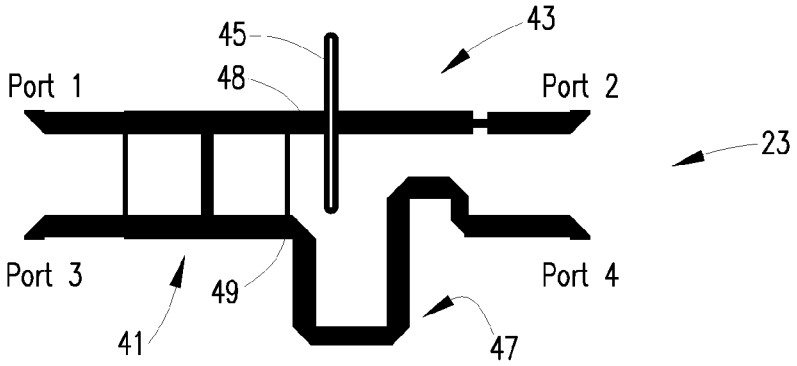
FIG. 4 diagrammatically illustrates the comparator components of FIG. 2 according to example embodiments of the present work.

FIG. 4 diagrammatically illustrates an example of the 0°/180° comparator 23 according to the present work. The comparator of FIG. 4 is a planar stripline component, constructed with a conventional double-box 90° branchline coupler 41, cascaded with a phase shifter 43 that includes a conventional Schiffman loop 45. Power input at port 1 exits at port 2 and port 4, as does power input at port 3. The double-box coupler configuration supports relatively wider bandwidth operation. The Schiffman loop structure 45 has an electrical path length that is 90° less than that of the meandering line section shown at 47. The Schiffman loop 45 contains highly-coupled lengths of transmission line that create an S-shaped phase response, as is conventional. Due to the S-shaped phase delay of the Schiffman loop, the 180°-differing phase delay profiles of both the Schiffman loop branch 48 and the meandering line branch 49 may be maintained substantially parallel to one another, thus enabling operation over relatively wide bandwidths. The trace widths of the stripline components illustrated in FIGS. 3 and 4 may be tailored to the desired range of frequency operation, as is conventional. Various embodiments include design features associated with conventional techniques. For example, FIG. 4 shows that a small section of line with significantly narrowed width (near port 2) may be provided according to conventional techniques to achieve a desired matching characteristic.

In some embodiments, the comparator component of FIG. 4 (minus the chamfered 90° bends at each port) has the same length as the crossover component of FIG. 3, namely 33.5 mm. The legs of the comparator (adjacent the chamfered bends near each port in FIG. 4) are separated by a leg separation distance of 6.7 mm, which is the same as the leg separation distance of the crossover component of FIG. 3. Thus, the four ports of the comparator component of FIG. 4 fit into the same-sized footprint as the four ports of the crossover component of FIG. 3. This characteristic provides network creation simplicity.

Figure 5:
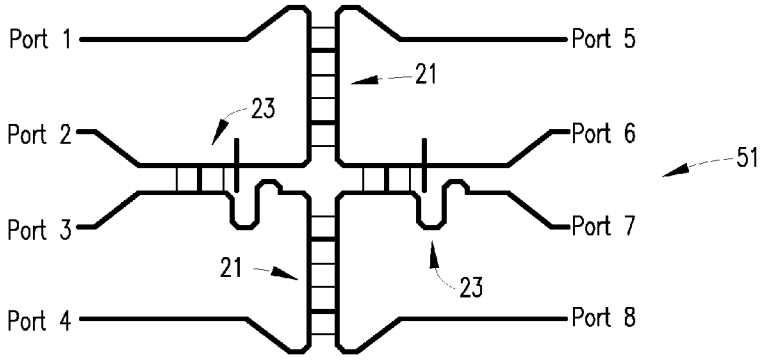
FIG. 5 diagrammatically illustrates the distribution network of FIG. 2, constructed with the stripline components of FIGS. 3 and 4 according to example embodiments of the present work.

FIG. 5 shows at 51 the distribution network of FIG. 2, constructed with the stripline components of FIGS. 3 and 4, according to example embodiments of the present work. As shown in FIG. 5, the crossovers 21 are oriented to extend generally transversely to the direction of power propagation. This orientation minimizes the various path lengths in order to decrease the insertion losses. The Bayliss weights $B_1$ and $B_2$ are respectively applied to port 1 and port 2, and the Taylor weights $T_1$ and $T_2$ are respectively applied to port 3 and port 4. In some embodiments, the separation between adjacent ports, on both the input side (port 1-port 4) and the output side (port 5-port 8), is set to 20.915 mm, to avoid grating lobes during X-band operation.

Figure 6:
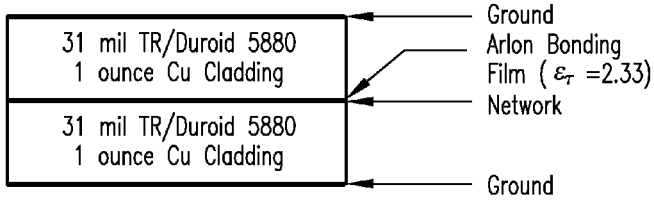
FIG. 6 is a cross-sectional view showing a laminar structure used according to example embodiments of the present work to realize a planar stripline network such as shown in FIG. 5.

FIG. 6 is a cross-sectional view showing a laminar structure used according to example embodiments of the present work to realize a planar stripline network such as shown at 51 in FIG. 5. The network is constructed with stripline components such as shown in FIGS. 3 and 4 according to example embodiments of the present work. Starting with first and second identical layers, each constructed of 31 mil thick RT/Duroid 5800 material between one ounce copper cladding on its opposite surfaces, the copper cladding is stripped completely from one surface of the first layer, and the copper cladding on one surface of the second layer is etched to produce the distribution network (e.g., the network 51 of FIG. 5). The first and second layers are bonded together with the stripped surface of the first layer facing the etched surface of the second layer. Some embodiments use a 1.5 mil Arlon bonding film as shown in FIG. 6. Copper cladding is provided respectively on the opposite outer surfaces of the laminar structure to define ground planes as shown.

Figure 7:
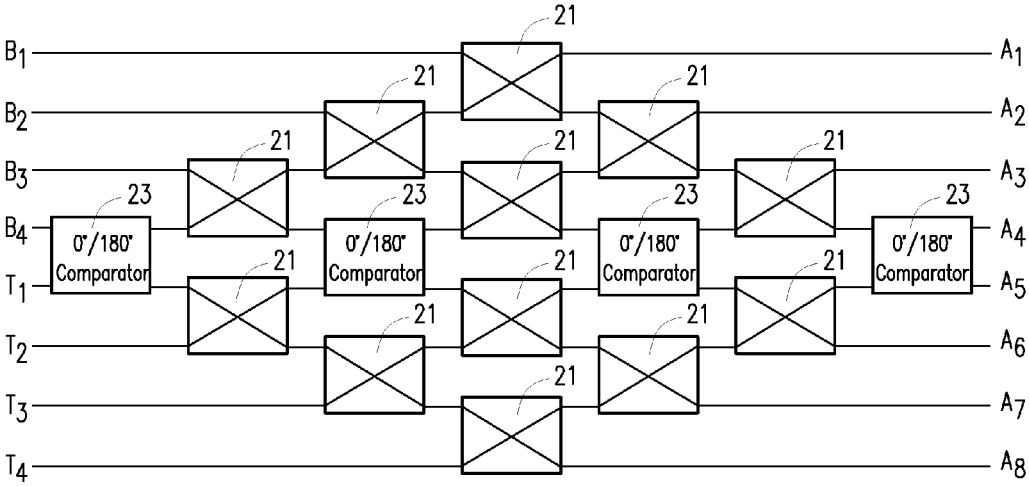
FIG. 7 diagrammatically illustrates a network, according to example embodiments of the present work, which is similar to that of FIG. 2, but with more ports and correspondingly more crossover and comparator components.
Figure 8:
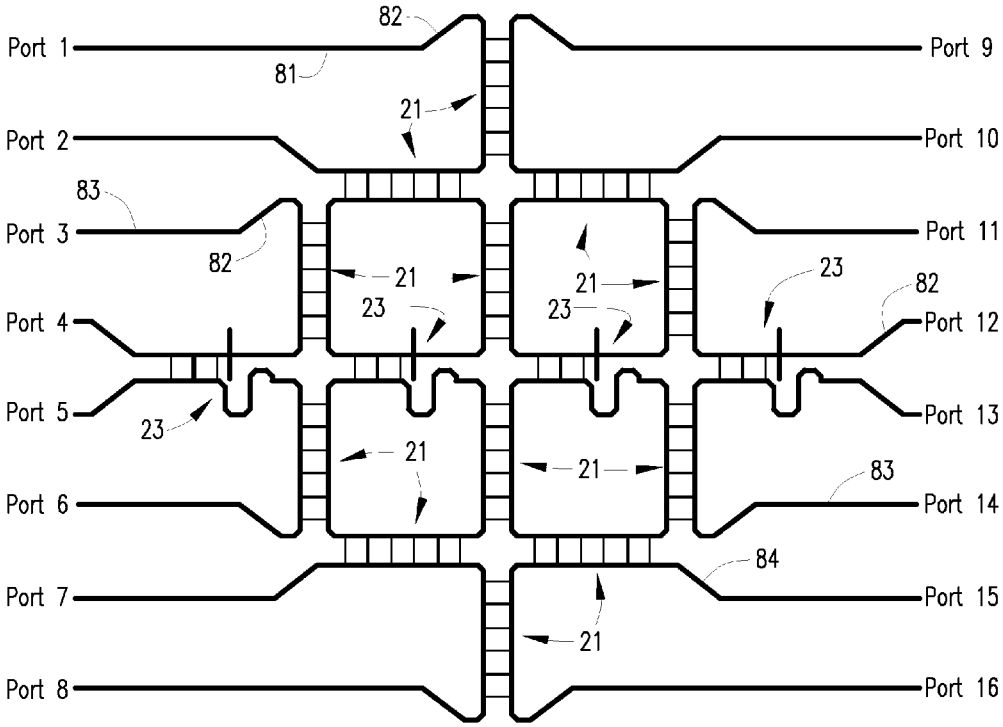
FIG. 8 is similar to FIG. 5, diagrammatically illustrating the distribution network of FIG. 7, constructed with the stripline components of FIGS. 3 and 4 according to example embodiments of the present work.

FIG. 7 diagrammatically illustrates a distribution network similar to that of FIG. 2, but with eight input ports and eight output (antenna) ports. Here twelve crossovers 21 are needed to accomplish the proper phasing at the antenna ports. FIG. 8 is similar to FIG. 5, but shows the larger network of FIG. 7 constructed with the stripline components of FIGS. 3 and 4. In FIG. 8, port 1-port 4 are respectively driven with the Bayliss weights $B_1$-$B_4$ shown in FIG. 7, port 5-port 8 are respectively driven with the Taylor weights $T_1$-$T_4$ shown in FIG. 7, and port 9-port 16 respectively correspond to the antenna outputs shown at $A_1$-$A_8$ in FIG. 7. One advantage of the aforementioned matching footprints of the FIG. 3 crossover and the FIG. 4 comparator is demonstrated clearly in FIG. 8. More particularly, along any insertion path in FIG. 8, the number and type of components that the power traverses are either the same or equivalent.

For instance, in FIG. 8, power that propagates from port 1 to port 12 traverses a long line 81, transverse adjuster 82, three consecutive crossovers 21, a comparator 23, and another transverse adjuster 82, in that order. Similarly, power that propagates from port 3 to port 15 traverses a medium length line 83, a transverse adjuster 82, a crossover 21, a comparator 23, two consecutive crossovers 21, a transverse adjuster 84, and another medium length line 83, in that order. Both paths contain three crossovers, one comparator, and two transverse adjusters. However, the port 1→port 12 path contains one long line 81, whereas the port 3→port 15 path contains two medium-length lines 83. Nevertheless, the sum of the lengths of two medium-length lines 83 is equal to the length of a long line 81. Thus, the two paths are equivalent in phase length. This is true for any of the other paths as well. Of course, as indicated above relative to the comparator 23 of FIG. 4, power input at any of port 1-port 4 traverses two different paths having respectively different phase lengths that respectively correspond to the branches 48 and 49. Accordingly, for example, power input at port 1 in FIG. 8 exits at both port 12 and port 13, where port 12 and port 13 are 180° out of phase with one another. The footprint match between the FIG. 3 crossover and the FIG. 4 comparator becomes increasingly important with larger networks such as FIG. 8, inasmuch as they are difficult to simulate accurately or, in some cases, at all.

Figure 9:
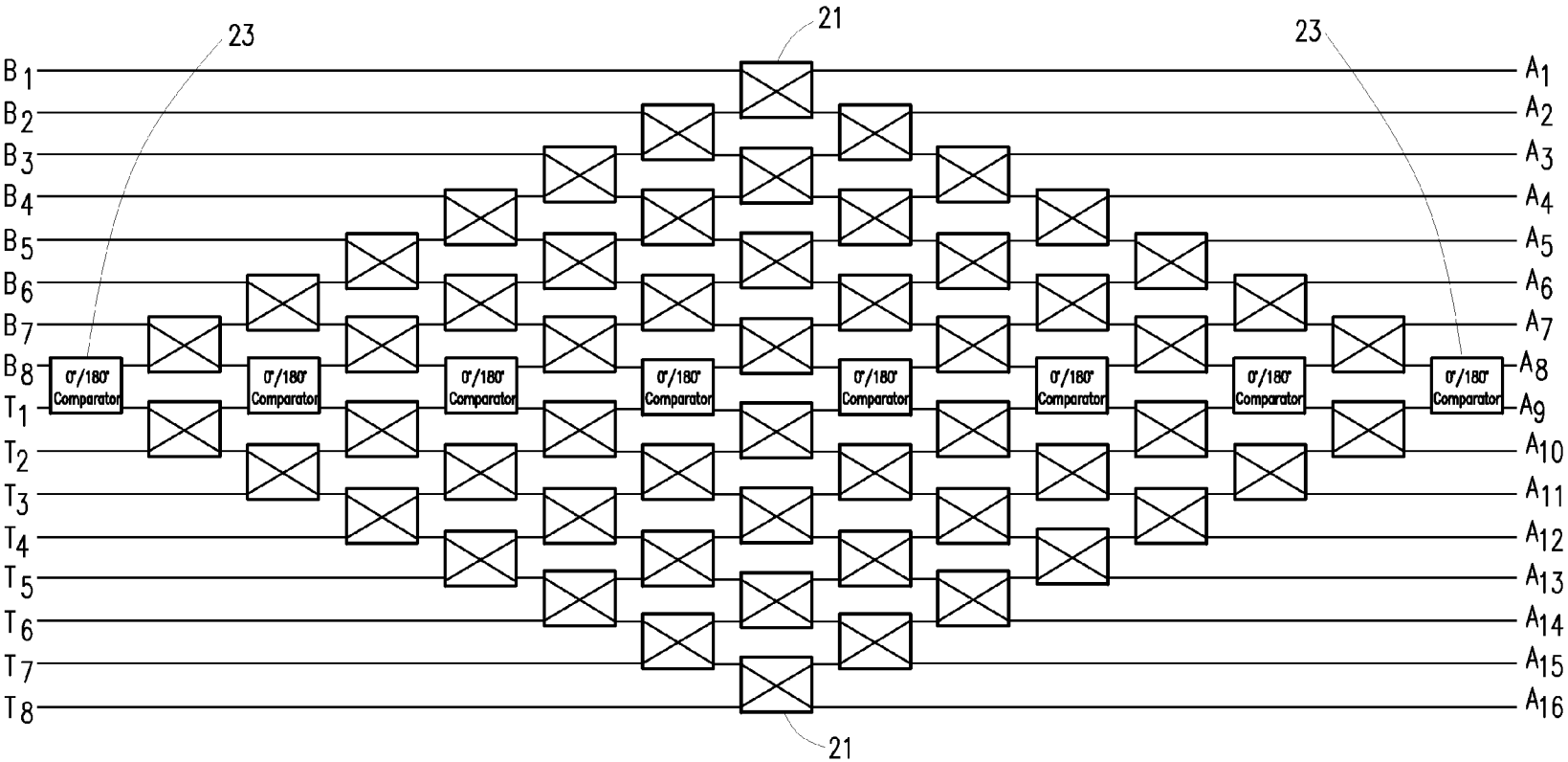
FIG. 9 diagrammatically illustrates a network, according to example embodiments of the present work, which is similar to that of FIG. 7, but with more ports and correspondingly more crossover and comparator components.
Figure 10:
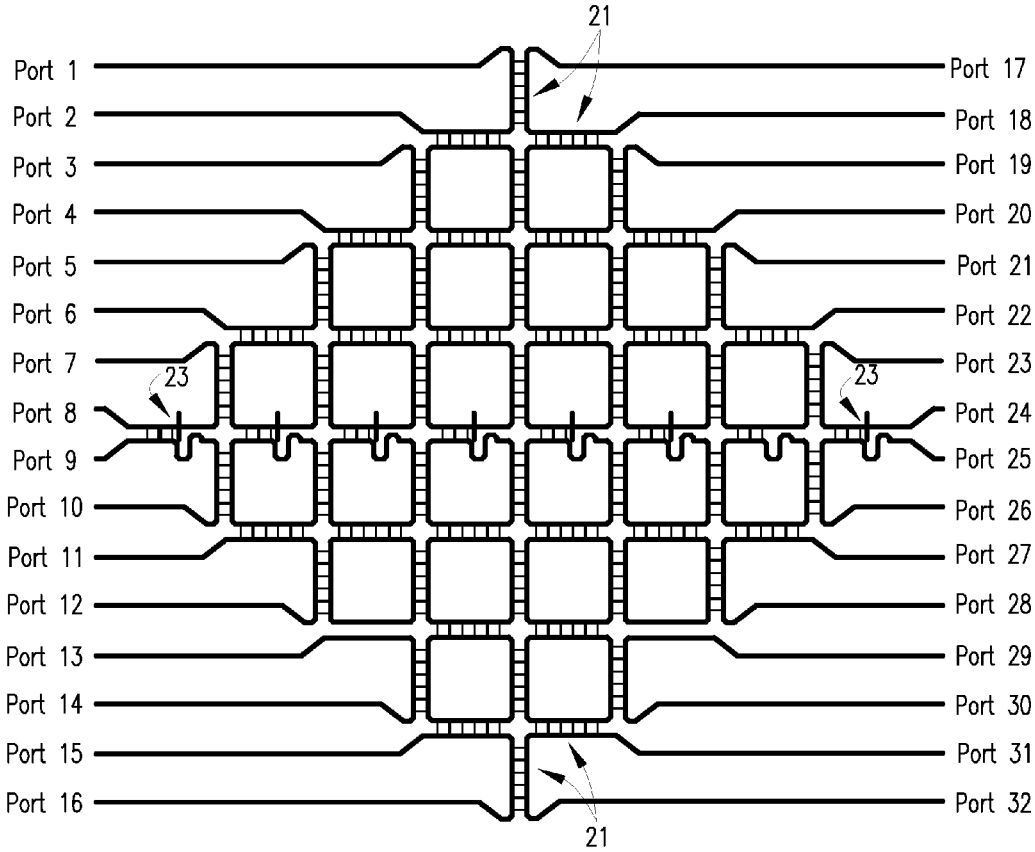
FIG. 10 is similar to FIG. 8, diagrammatically illustrating the distribution network of FIG. 9, constructed with the stripline components of FIGS. 3 and 4 according to example embodiments of the present work.

FIG. 9 diagrammatically illustrates a distribution network similar to those of FIGS. 2 and 7, but with 16 input ports and 16 output (antenna) ports. Here, 56 crossovers 21 are required to accomplish the proper phasing at the antennas $A_1$-$A_{16}$. FIG. 10 is similar to FIGS. 5 and 8, but shows the larger network of FIG. 9 constructed with the stripline components of FIGS. 3 and 4. The Bayliss weights $B_1$-$B_8$ of FIG. 9 are respectively applied to port 1-port 8 of FIG. 10, the Taylor weights $T_1$-$T_8$ of FIG. 9 are respectively applied to port 9-port 16 of FIG. 10, and the antenna outputs shown at $A_1$-$A_{16}$ in FIG. 9 respectively correspond to port 17-port 32 in FIG. 10. Because the FIG. 4 comparators and FIG. 3 crossovers have the same footprint (as discussed above), proper phase control for networks such as FIG. 10, that are electrically too large to simulate, may be ensured.

The network examples described above according to the present work use crossover components similar to those found in conventional Butler matrices commonly used for discrete beam steering. However, the phasings for the Bayliss/Taylor networks of the present work are different from those of a Butler matrix. For example, in a 16-input×16-output Butler matrix, a linear phase front is achieved across the antenna elements for proper beam pointing. In contrast, for example, a network such as shown in FIGS. 9 and 10 provides an equal-phase front over $A_1$ to $A_{16}$ when the $T_1$-$T_8$ Taylor weights are excited and the $B_1$-$B_8$ ports are terminated to 50Ω. Conversely, if the $B_1$-$B_8$ Bayliss weights are excited with the $T_1$-$T_8$ ports terminated to 50Ω, then the phase at each antenna output port $A_1$ through $A_8$ will be some phase value $\phi_1$, while the phase at each antenna output port $A_9$ through $A_{16}$ will be $\phi_1$+180°.

Although the examples described above relate to a planar arrangement with a linear (i.e., one-dimensional) antenna array, some embodiments use a two-dimensional antenna array, wherein the N antennas shown in FIG. 1 are replaced by N linear antenna arrays, respectively. The Bayliss and Taylor aperture distributions can be realized along both orthogonal dimensions of the resulting two-dimensional antenna array by providing: (1) N distributors (i.e., N Bayliss/Taylor distribution networks), one for each of the N linear antenna arrays; and (2) one additional distributor to combine the N combinations of linear antenna array/distributor.

Although example embodiments of the present work are described above in detail, this does not limit the scope of the present work, which can be practiced in a variety of embodiments.

What is claimed is:

1. A planar monopulse radar apparatus, comprising:

first and second input ports;

a planar antenna array having a linear configuration of antenna elements, the antenna elements including a first antenna element, a second antenna element, a third antenna element, and a fourth antenna element;

a planar feed network between said antenna array and said first and second input ports, the feed network having a first input to a distribution matrix, a second input to the distribution matrix, a third input to the distribution matrix, and a fourth input to the distribution matrix, the planar feed network comprises:

the distribution matrix that connects the first input, the second input, the third input, and the fourth input to the antenna array, the distribution matrix comprising:

a first crossover component and a second crossover component; and a first comparator component and a second comparator component, the first input connected to the second antenna element and the third antenna element via the first comparator component and the first crossover component, the second input connected to the first antenna element and the fourth antenna element via the second comparator component and the first and second crossover components, the third input connected to the first antenna element and the fourth antenna element via the second comparator and the first and second crossover components, and the fourth input connected to the second antenna element and the third antenna element via the second crossover component and the first comparator component, wherein the feed network is configured to provide both sum and difference beam distributions across said antenna array responsive to power being applied at said first and second input ports.

2. The apparatus of claim 1, wherein said sum beam distribution is a Taylor distribution and said difference beam distribution is a Bayliss distribution.

3. The apparatus of claim 1, wherein said feed network further includes first and second power splitters respectively coupled to said first and second input ports, wherein said first power splitter is configured to output a first plurality of weights associated with said sum distribution responsive to the power being applied at said first input port, and wherein said second power splitter is configured to output a second plurality of weights associated with said difference beam distribution responsive to the power being applied at said second input port.

4. The apparatus of claim 3, wherein said first plurality of weights are associated with a Taylor distribution and said second plurality of weights are associated with a Bayliss distribution.

5. The apparatus of claim 3, wherein said distribution matrix is configured to provide an equal phase front over said antenna array responsive to said first plurality of weights, and said distribution matrix configured to provide, over respective groups of adjacent antenna elements, respective equal phase fronts that are 180° out of phase with one another responsive to said second plurality of weights.

6. The apparatus of claim 3, wherein said distribution matrix includes a plurality of crossover components and a plurality of 0/180° comparator components, the first and second crossover components included in the plurality of crossover components, the comparator component included in the plurality of 0/180° comparator components.

7. The apparatus of claim 6, wherein said crossover components respectively include two cascaded double-box 90° branchline couplers, and wherein said 0/180° comparator components respectively include a double-box 90° branchline coupler cascaded with a phase shifter.

8. The apparatus of claim 6, wherein said crossover components and said 0/180° comparator components all have an equal number of connection ports, and wherein said connection ports of said crossover components and said connection ports of said 0/180° comparator components fit within a same size footprint.

9. The apparatus of claim 6, wherein a majority of said crossover components are oriented to extend transversely to a direction of power propagation across said distribution matrix from said first and second power splitters to said antenna array.

10. The apparatus of claim 6, wherein said crossover components and said 0/180° comparator components are arranged to collectively provide a plurality of power distribution paths from said power splitters to said antenna array, and wherein all of power distribution paths have equivalent phase lengths.

11. The apparatus of claim 6, wherein each said 0/180° comparator component includes two branches having respective phase delay profiles that are substantially parallel to one another.

12. A planar monopulse radar apparatus, comprising:

a first plurality of input ports comprising a first input port and a second input port, the first input port and the second input port being respectively connected to output ports of a Bayliss power splitter;

a second plurality of input ports comprising a third input port and a fourth input port, the third input port and the fourth input port being respectively connected to an output of a Taylor power splitter;

a planar antenna array having a linear configuration of antenna elements, the antenna elements comprising a first antenna element, a second antenna element, a third antenna element, and a fourth antenna element; and a planar distribution matrix coupled to said antenna array, said first input port, said second input port, said third input port, and said fourth input port, the planar distribution matrix comprising:

first and second crossover components; and first and second comparator components, the first and second crossover components and the first and second comparator components distribute weights at each input port to two antenna elements in the planar antenna array, such that said distribution matrix is configured to provide a sum beam distribution across the antenna elements responsive to first weights applied at said first plurality of input ports via the Bayliss power splitter, said distribution matrix further configured to provide a difference beam distribution across the antenna elements responsive to second weights applied at said second plurality of input ports via the Taylor power splitter.

13. The apparatus of claim 12, wherein said distribution matrix includes a plurality of crossover components and a plurality of 0/180° comparator components, the first and second crossover components included in the plurality of crossover components, the first and second comparator components included in the plurality of 0/180° comparator components.

14. The apparatus of claim 13, wherein said crossover components respectively include two cascaded double-box 90° branchline couplers, and wherein said 0/180° comparator components respectively include a double-box 90° branchline coupler cascaded with a phase shifter.

15. The apparatus of claim 13, wherein said crossover components and said 0/180° comparator components all have an equal number of connection ports, and wherein said connection ports of said crossover components and said connection ports of said 0/180° comparator components fit within a same size footprint.

16. The apparatus of claim 13, wherein a majority of said crossover components are oriented to extend transversely to a direction of power propagation across said distribution matrix from the Bayliss power splitter and the Taylor power splitter to said antenna array.

17. The apparatus of claim 13, wherein said crossover components and said plurality of 0/180° comparator components are arranged to collectively provide a plurality of power distribution paths between the Bayliss power splitter and the Taylor power splitter to said antenna array, and wherein all of said power distribution paths have equivalent phase lengths.

18. The apparatus of claim 13, wherein each said 0/180° comparator component includes two branches having respective phase delay profiles that are substantially parallel to one another.

19. The apparatus of claim 13, wherein said antenna array contains $N_a$ antenna elements, wherein said plurality of 0/180° comparators numbers $N_a/2$ and wherein said plurality of crossover components $N_x$ numbers:

$$N_x = 2\sum_{m=1}^{\frac{N_a}{2}}\left(\frac{N_a}{2} - m\right)$$

20. The apparatus of claim 12, wherein the distribution matrix is constructed as a stripline network.

* * * * *